US005579634A

United States Patent [19]

Taylor, Jr.

[11] Patent Number: 5,579,634

[45] Date of Patent: Dec. 3, 1996

[54] USE OF CONTROLLED BURN RATE, REDUCED SMOKE, BIPLATEAU SOLID PROPELLANT FORMULATIONS

[75] Inventor: Robert H. Taylor, Jr., Harvest, Ala.

[73] Assignee: Thiokol Corporation, Ogden, Utah

[21] Appl. No.: 222,423

[22] Filed: Apr. 1, 1994

Related U.S. Application Data

[60] Division of Ser. No. 981,774, Nov. 25, 1992, Pat. No. 5,334,270, which is a continuation-in-part of Ser. No. 827, 207, Jan. 29, 1992, abandoned.

[51] Int. Cl.[6] ..... C06D 5/06

[52] U.S. Cl. ..... 60/219; 60/205; 149/19.92

[58] Field of Search ..... 149/19.4, 19.9, 149/19.92; 60/205, 219

[56] References Cited

U.S. PATENT DOCUMENTS

| | | | |
|---|---|---|---|
| H747 | 2/1990 | Jacobs et al. | 60/242 |
| 3,073,112 | 1/1963 | Bleikamp | 60/35.6 |
| 3,094,072 | 6/1963 | Parilla | 102/50 |
| 3,452,544 | 1/1969 | Glick et al. | 60/254 |
| 3,822,154 | 7/1974 | Lawrence et al. | 149/19.1 |
| 3,870,578 | 3/1975 | Nichols, Jr. | 149/19.4 |
| 3,924,405 | 9/1975 | Cohen et al. | 60/219 |
| 3,972,846 | 8/1976 | Mori et al. | 260/30.4 N |
| 3,979,486 | 9/1976 | Herchin et al. | 264/3 B |
| 3,986,910 | 10/1976 | McCulloch et al. | 149/19.9 |
| 4,084,992 | 4/1978 | Hightower et al. | 149/17 |
| 4,098,626 | 7/1978 | Graham et al. | 149/19.4 |
| 4,099,376 | 7/1978 | Japs | 60/253 |
| 4,110,135 | 8/1978 | Graham et al. | 149/19.4 |
| 4,181,545 | 1/1980 | Anderson | 149/19.9 |
| 4,184,031 | 1/1980 | Graham et al. | 528/55 |
| 4,214,928 | 7/1980 | Consaga | 149/19.9 |
| 4,263,071 | 4/1981 | Bain | 149/19.9 |
| 4,263,444 | 4/1981 | Graham et al. | 560/26 |
| 4,377,678 | 3/1983 | Fukuma et al. | 149/19.4 |
| 4,493,741 | 1/1985 | Ducote et al. | 149/19.4 |
| 4,498,292 | 2/1985 | White | 60/256 |
| 4,517,035 | 5/1985 | Duchesne et al. | 149/19.92 |
| 4,574,699 | 3/1986 | Bolieau | 102/202 |
| 4,597,924 | 7/1986 | Allen et al. | 264/3.6 |
| 4,655,858 | 4/1987 | Sayles | 149/19.92 |
| 4,655,860 | 4/1987 | Sayles | 149/19.92 |
| 4,658,587 | 4/1987 | Shaw | 60/205 |
| 4,798,636 | 1/1989 | Strecker | 149/19.9 |
| 4,913,753 | 4/1990 | Ducote | 149/19.9 |
| 4,971,640 | 11/1990 | Chi | 149/19.9 |

FOREIGN PATENT DOCUMENTS 93101181.1 1/1993 European Pat. Off. .

*Primary Examiner*—Edward A. Miller

*Attorney, Agent, or Firm*—Madson & Metcalf; Ronald L. Lyons

[57] ABSTRACT

Solid rocket motor propellant formulations are provided which are capable of burning at at least two selected burn rates. The burn rate is controlled by controlling the pressure at which the propellant burns. For example, it is possible to mechanically modify the container, such as a rocket motor casing, in which the propellant is held in order to modify the pressure under which the propellant burns. Alternatively, the propellant may be configured or molded such that the pressure changes at a chosen time due to the process of burning the propellant. The propellant is capable of burning at a relatively constant burn rate at a chosen pressure. Once the pressure changes which chosen limits, the burn rate of the propellant is rapidly modified to another relatively constant burn rate. The solid rocket motor propellant is formulated with the addition of from about 0.5% to about 4.0% $TiO_2$. The specific operating pressures and burn rates can be selected by modifying the amount of $TiO_2$ added, the modifying the particle size of the various ingredients, and modifying the specific ingredients used.

11 Claims, 6 Drawing Sheets

USE OF CONTROLLED BURN RATE, REDUCED SMOKE, BIPLATEAU SOLID PROPELLANT FORMULATIONS

RELATED APPLICATIONS

This application is a divisional of application Ser. No. 07/981,774, filed on Nov. 25, 1992, now U.S. Pat. No. 5,334,270, which is a continuation-in-part application of application Ser. No. 07/827,207 filed Jan. 29, 1992, now abandoned.

BACKGROUND

1. The Field of the Invention

The present invention is related to solid propellant compositions which are capable of burning at selected, and relatively constant, burn rates, including multiple burn rates. More particularly, the present invention is related to propellants which are formulated using one or more refractory oxides, such as $TiO_2$, $ZrO_2$, $Al_2O_3$, and $SiO_2$.

2. Technical Background

Solid propellants are used extensively in the aerospace industry. Solid propellants have developed as the preferred method of powering most missiles and rockets for military, commercial, and space applications. Solid rocket motor propellants have become widely accepted because of the fact that they are relatively simple to formulate and use, and they have excellent performance characteristics. Furthermore, solid propellant rocket motors are generally very simple when compared to liquid fuel rocket motors. For all of these reasons, it is found that solid rocket propellants are often preferred over other alternatives, such as liquid propellant rocket motors.

Typical solid rocket motor propellants are generally formulated having an oxidizing agent, a fuel, and a binder. At times, the binder and the fuel may be the same. In addition to the basic components set forth above, it is conventional to add various plasticizers, curing agents, cure catalysts, and other similar materials which aid in the processing and curing of the propellant. A significant body of technology has developed related solely to the processing and curing of solid propellants, and this technology is well known to those skilled in the art.

One type of propellant that is widely used incorporates ammonium perchlorate (AP) as the oxidizer. The AP oxidizer may then, for example, be incorporated into a propellant which is bound together by a hydroxy-terminated polybutadiene (HTPB) binder. Such binders are widely used and commercially available. It has been found that such propellant compositions provide ease of manufacture, relative ease of handling, good performance characteristics; and are at the same time economical and reliable. In essence it can be said that AP composite propellants have been the backbone of the solid propulsion industry for approximately the past 40 years.

One of the problems encountered in the design of rocket motors is the control of the thrust output of the rocket motor. This is particularly true when it is desired to operate the motor in two or more different operational modes. For example, it is often necessary to provide a high level of thrust in order to "boost" the motor and its attached payload from a starting position, such as during launch of a rocket or missile. Once the launch phase has been completed, it may be desirable to provide a constant output from the rocket motor over an extended "sustain" operation. This may occur, for example, after the rocket has been placed in flight and while it is traveling to its intended destination.

In certain applications, it may be desired to provide more than one boost phase or more than one sustain phase. For example, it may be desired to boost the rocket motor into flight, then sustain flight at a particular speed and altitude, and then once again boost the rocket motor to a higher altitude or faster speed. Such operation will at times be referred to herein as "biplateau" operation, referring to providing two or more substantially level burn rates during operation of the motor.

Until now, the performance of such multi-phased or biplateau operations has been extremely difficult. It has been necessary to resort to complex mechanical arrangements in the rocket motors. Alternatively, less efficient and less desirable liquid rocket motors have been used to obtain multi-phase operation.

In some cases, multiple-phase or biplateau operation has been attempted by constructing very complex propellant grains, such as grains having multiple propellants. In any case, achievement of multiple-phase operation has been complex, time consuming, and costly.

Accordingly, it would be an advancement in the art to provide propellant formulations which overcame the limitations of the art as set for above, and were capable of managed energy output. More particularly, it would be an advancement in the art to provide propellant formulations which were capable of operating at multiple stable outputs. Specifically, it would be an advancement in the art to provide propellant formulations which were "biplateau" in nature. Alternatively, it would be an advancement in the art to provide propellants which were capable of operating at a more precise and predictably controlled single plateau.

It would be a further advancement in the art to provide such propellant formulations in which the burn rate could be selected or changed during operation. Specifically, it would be a significant advancement in the art to provide such propellants which were capable of operating at more than one burn rate, depending on the pressure under which the propellant is burning. It would also be an advancement in the art to provide methods for using such propellants in the operation of a solid propellant rocket motor.

Such methods and compositions are disclosed and claimed herein.

BRIEF SUMMARY AND OBJECTS OF THE INVENTION

The formulation of the present invention allows for stable propellant burning pressures, and provides the capability of achieving two or more stable operating pressures with a single propellant. This is a significant improvement over the existing art. The present invention simplifies and lowers the cost of boost-sustain and sustain-boost motor manufacture by requiring only a single propellant. Using the formulations of the present invention, higher volumetric loading with a simple center perfacate (CP) grain design for boost-sustain motors is provided. The formulations of the present invention are stable at operating pressures up to approximately 7000 psi. The formulations are made using primarily commercially available and known ingredients. The present invention is also applicable to reduced-smoke and aluminized propellants.

An important ingredient in achieving the stable and multi-phase or biplateau characteristics is the addition of an acceptable quantity of a refractory oxide. Such oxides are generally selected from the group consisting of $TiO_2$, $ZrO_2$, $Al_2O_3$, and $SiO_2$, and similar materials. These materials function essentially as burn rate catalysts in the propellant formulation and provide the ability to tailor the burn rate achieved by the propellant.

In certain preferred embodiments of the invention $TiO_2$ is employed. $TiO_2$ is low cost and commercially available in large quantity. For example, good results have been achieved using $TiO_2$ obtained from Degussa Chemical, including products identified by Degussa as P-25 and T-805. These commercially available materials are provided in coated form, which improves the processing of the composition. The $TiO_2$ is generally coated with Siloxanes.

For most applications, the preferred refractory oxide content in the propellant will be in the range of from approximately 0.5% to approximately 4.0%, by weight. Excellent results have been achieved with refractory oxides added in the range of from approximately 1.0% to approximately 2.0%. It has also been found that a wide range of particle sizes also provide good results. In particular, particles sizes of from approximately 0.4μ to approximately 0.02μ perform well, the former for lower burn-rate ranges and the latter for higher burn-rate ranges.

Other ingredients and composition characteristics may be varied in order to obtain specific desired characteristics. For example, variation of secondary factors and ingredients may influence the specific burn rates and pressure ranges of operation. Such factors may, for example, include AP particle size, distribution and content, plasticizer content, the type of cure agent used, and the presence of other trace components.

Accordingly, it is a primary object of the present invention to provide propellant formulations which overcome the limitations of the art as set for above and are capable of managed energy output.

More particularly, it is an object of the present invention to provide propellant formulations which are capable of operating in a selected stable or biplateau manner.

It is a related object to provide propellant formulations which are capable of operating at at least two substantially stable burn rates.

It is another object of the present invention to provide such propellant formulations in which the burn rate can be selected or changed during operation.

It is also an object of the present invention to provide such propellants which are capable of operating at more than one burn rate, depending on the pressure under which the propellant is burning.

It is a further object of the invention to provide methods for controlling the operation of a solid propellant rocket motor.

These and other objects and advantages of the invention will become apparent upon reading the following detailed description and appended claims, and upon reference to the accompanying drawings

BRIEF DESCRIPTION OF THE DRAWINGS

In order that the manner in which the above-recited and other advantages and objects of the invention are obtained, a more particular description of the invention will be rendered by reference to the appended drawings. Understanding that these drawings depict only data related to typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
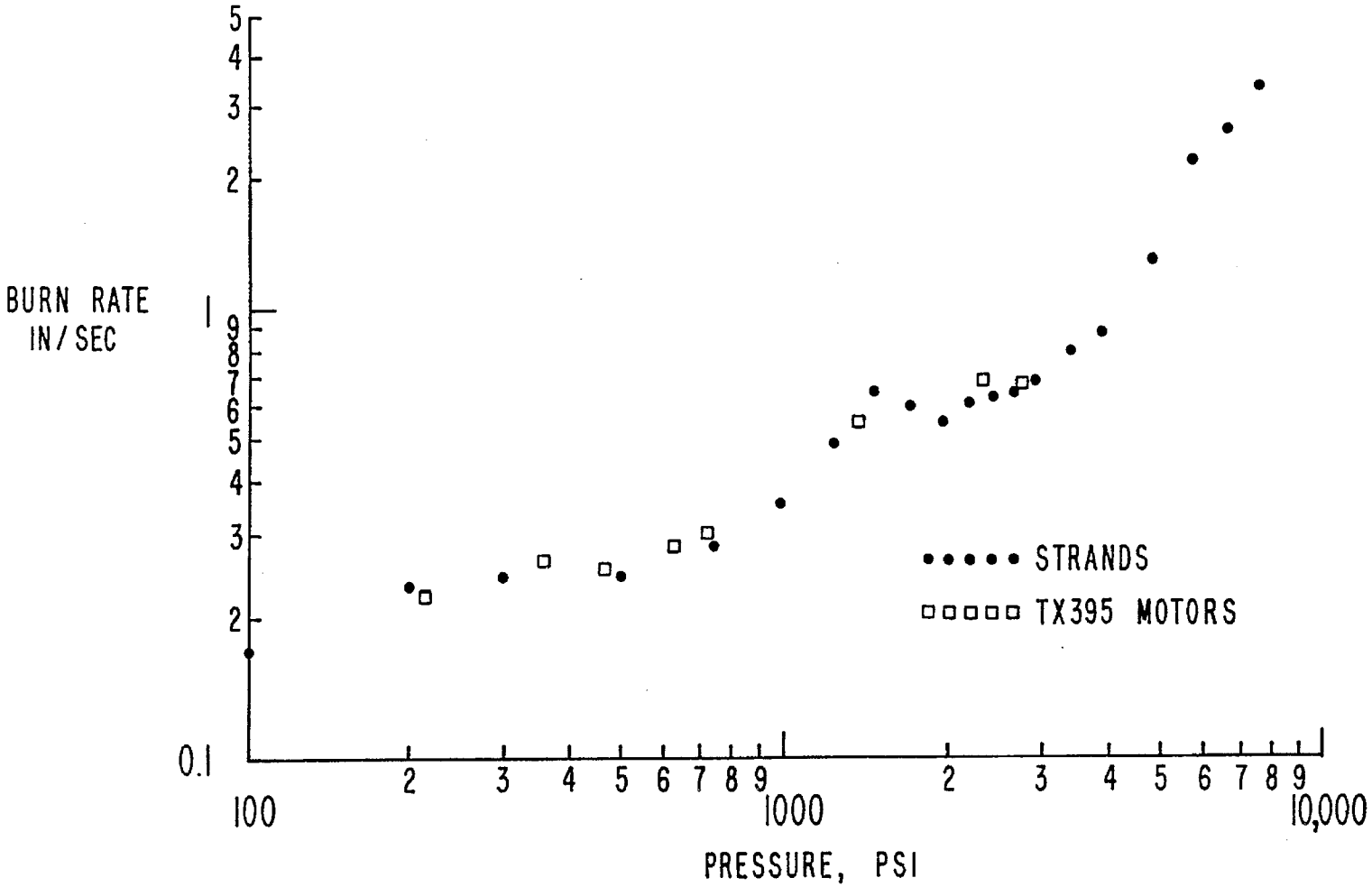
FIG. 1 is a burning rate versus pressure plot for a composition within the scope of the invention in which both strand data and motor data are presented.

The present invention provides a solid rocket motor propellant which is capable of burning at predetermined stable burn rates. In several embodiments of the present invention, the propellant is capable of burning at at least two selected burn rates.

The burn rate is precisely controlled by controlling the pressure at which the propellant burns. For example, it is possible to mechanically modify the container, such as a rocket motor casing, in which the propellant is held in order to modify the pressure under which the propellant burns. Alternatively, the propellant may be configured or molded such that the pressure changes at a chosen time due to the process of burning the propellant. The propellant is capable of burning at a relatively constant burn rate at a chosen pressure. Once the pressure changes within chosen limits, the burn rate of the propellant is rapidly modified to another relatively constant burn rate.

The solid rocket motor propellants of the present invention are formulated with essentially known propellant ingredients, plus the addition of from about 0.5% to about 4.0% of refractory oxide, such as $TiO_2$, $ZrO_2$, $Al_2O_3$, and $SiO_2$. $TiO_2$ has been found to give particularly favorable results. $TiO_2$ is readily available on the commercial market, such as P-25 and T-805 manufactured by Degussa Chemical.

As mentioned above, the specific operating pressures and burn rates can be selectively modified by modifying the amount of refractory oxide added, the particle size of the various ingredients, and varying the specific ingredients used. In one preferred embodiment of the present invention, the propellant is formulated from the following ingredients in approximately the following weight percentages:

| | |
|---|---|
| R45M | 6.00–10.00 |
| Tepanol | 0.05–0.15 |
| DOA | 1.00–3.00 |
| $TiO_2$ | 0.30–5.0 |
| AP | 65.00–90.00 |
| ODI | 0.01–0.08 |
| TPB | 0–0.02 |
| DDI/IPDI | 0.50–2.00 |

Among the abbreviations and tradenames used herein are:

| | |
|---|---|
| R45M | hydroxy-terminated polybutadiene (HTPB) binder, manufactured by Atochem |
| DOA | dioctyldipate |
| ODI | octadecylisocyanate |
| TPB | triphenylbismuth |
| DDI | dimeryl diisocyanate |
| IPDI | isophorone diisocyanate |
| AP | ammonium perchlorate |
| Tepanol | HX878 |
| MAO | mixed antioxidant |

In the exemplary formulation set forth above, the specific ingredients listed are examples of the types of ingredients used in the formulation of the propellant, but other similar materials may be substituted as is well known to those skilled in the art. For example, Tepanol is a bonding agent manufactured and commercially available from 3M Corporation. Other similar known bonding agents may also be used or combined with Tepanol. Likewise DOA may be used, or other similar chemical species may be incorporated. R45M is an example of a typical commercially available HTPB binder, however, other similar binders are also available such as R45M AS, R45HT manufactured by ARCO Chemical Co.

Importantly, the present invention is usable in a number of different types of propellant formulations. For example, the present invention may be employed in reduced smoke propellants or in aluminized propellant formulations. As a result, the present invention has wide applicability in the design of propellant formulations.

Ammonium perchlorate is generally incorporated into the formulation in the manner known in the art and AP of multiple particle sizes may be used. In one exemplary embodiment, approximately 53% AP having a particle size of 400μ is combined with approximately 33% AP having a particle size of 1.7μ. This combination provides good performance when placed into the compositions of the present invention. Other particular sizes and combinations of particles sizes may be used in order to vary the pressures and burn rates in the biplateau regions.

ODI is an ammonia scavenger and processing aid, but other similar types of species may be added in addition to or in place of the ODI. Likewise, TPB is a cure catalyst and DDI is a curing agent. These and other curing agents and cure catalysts may be used as needed to prepare a formulation with specific desired characteristics.

A summary of the ballistic performance of several typical formulations is presented in Table 1 below. As the data show, it is possible to control the ballistic behavior over fairly broad ranges by selection of easily varied formulation parameters. In the formulations shown in Table I, $TiO_2$ is added to between 0.4% and 2.0% of the total composition. The particle size of $TiO_2$ varies between 0.02μ and 0.4μ. The curing agents used include IPDI, DDI, or mixtures of IPDI and DDI. Acceptable results are achieved with each of these combinations of formulation parameters.

Small changes in the formulation, such as $TiO_2$ particle size and content, cure agent, DOA content, and AP size and distribution can be used to adapt the range of the observed plateau regions. If desired, changes in the Tepanol content may be made to improve the processing and mechanical properties for particular applications. In Table I below, the influence of several of these variables on the pressure range and burn rates at which these dual plateaus occurred is observed.

Figure 2:
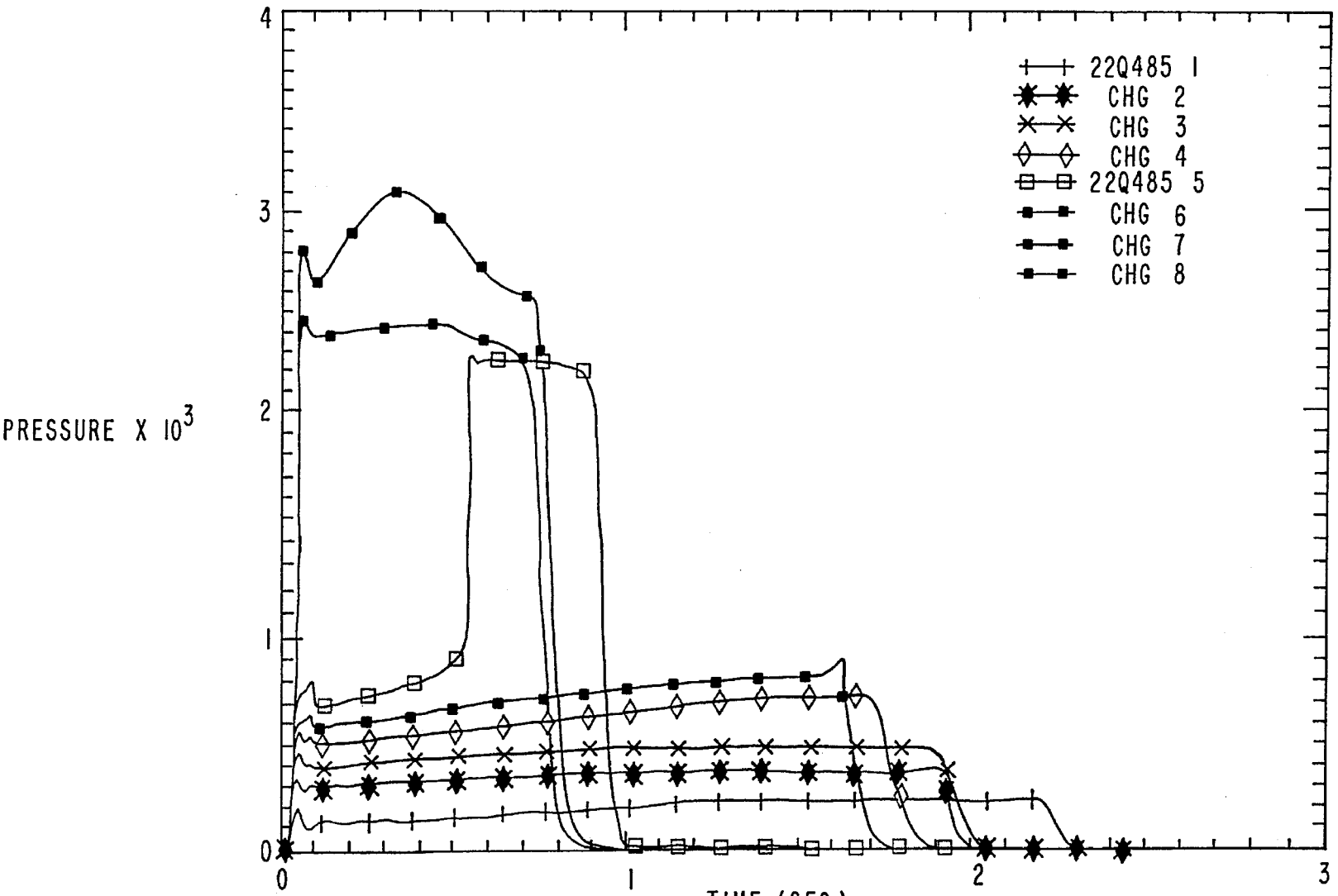
FIG. 2 is a graph illustrating biplateau burn rate curves in motors.

FIG. 2 is a graph showing pressure plotted against time in seconds. FIG. 2 illustrates the variability demonstrated in reduced smoke formulations, including the achievement of biplateau operation. FIG. 2 illustrates that by progressively increasing motor burn surface area/throat area ("Kn"), the motor starts on the low pressure plateau, moving through the transition region, and then ending on the high pressure plateau. Stable operation is achieved on each plateau. This biplateau ballistic performance has been demonstrated in both 2"×4" and 6"×12" ballistic test motors.

Figure 3:
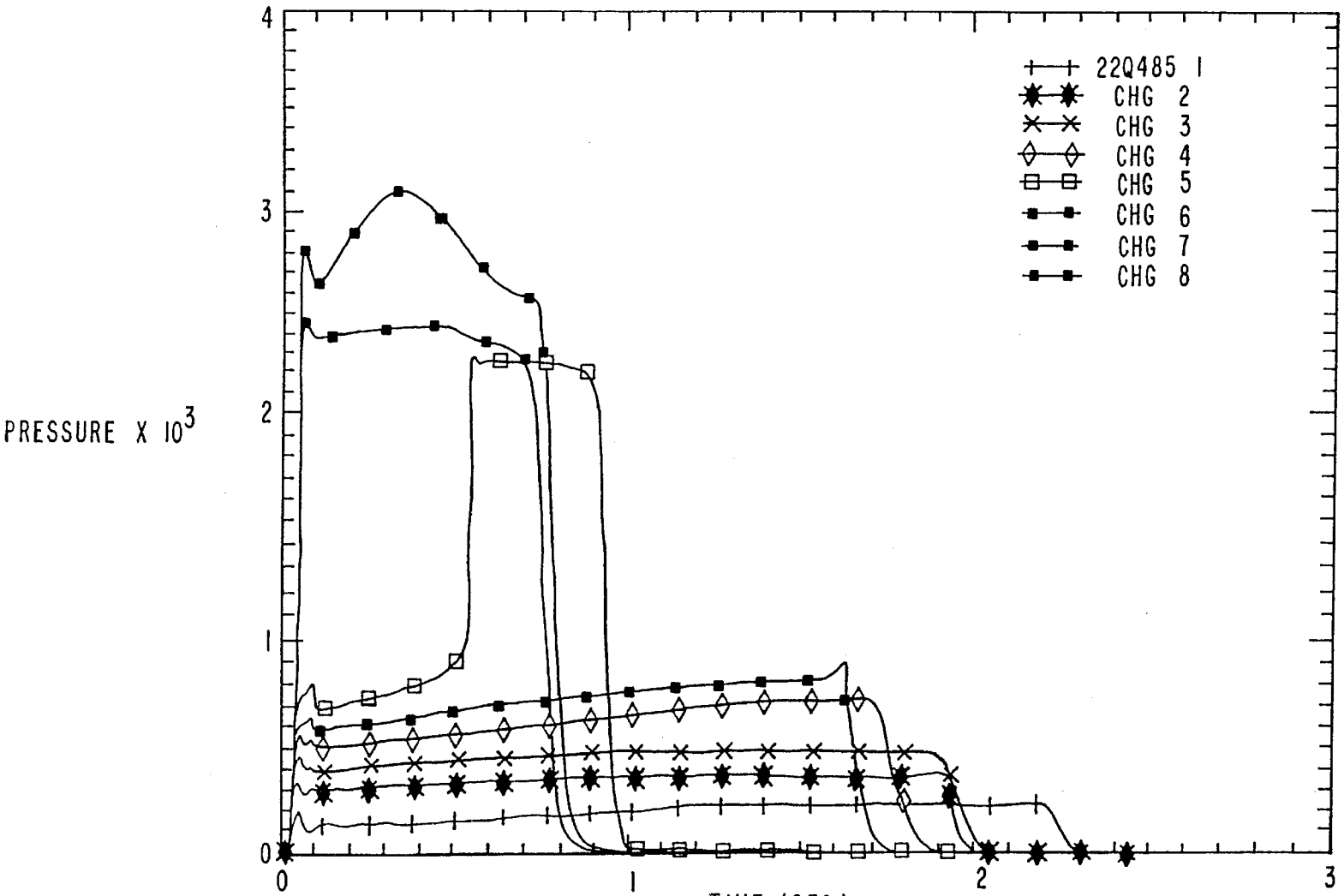
FIG. 3 is a graph illustrating small motor demonstration of boost-sustain operation with biplateau propellant.

FIG. 3 shows that by coupling ¼" and ½" web motors at different Kn values, high pressure operation was successfully followed by low pressure operation. The third motor was intentionally started in the transition pressure region, climbed to a boost pressure, and then completed at a sustain pressure.

Figure 4:
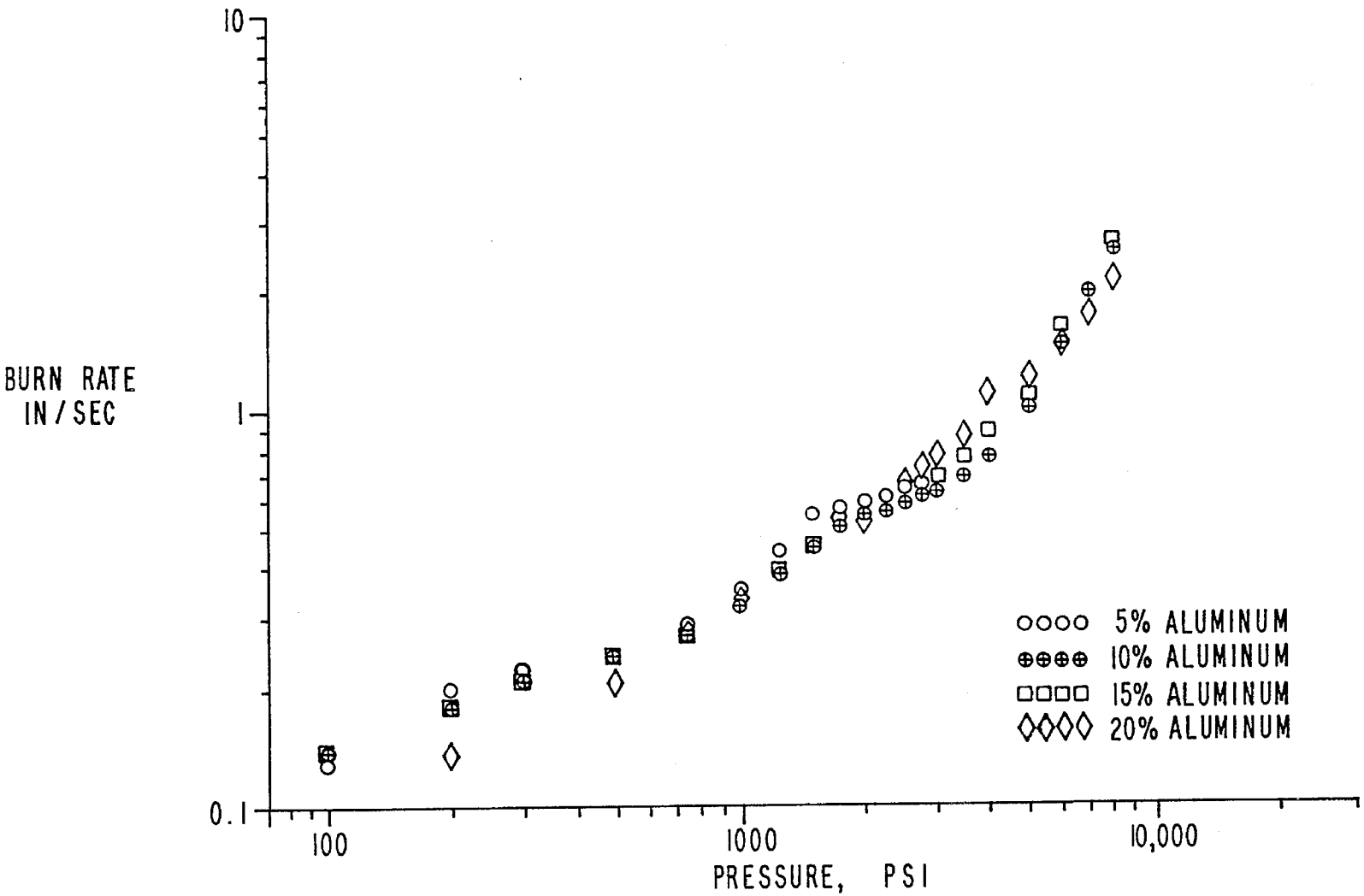
FIG. 4 is a burn rate versus pressure plot illustrating the performance of four aluminized propellants.

FIG. 4 is a plot of burn rate versus pressure for four (4) aluminized formulations. The percentage of aluminum in the compositions was 5%, 10%, 15%, and 20%. FIG. 4 illustrates the plateaus achieved with each of these compositions. Accordingly, it will be appreciated that the present invention is useful in application to aluminized propellant formulations. In such formulations, it is expected that aluminum will be added to form from about 3% to about 20% of the composition by weight. As can be seen in FIG. 4, changes in the amount of aluminum results in subtle changes in the performance of the propellant.

Figure 5:
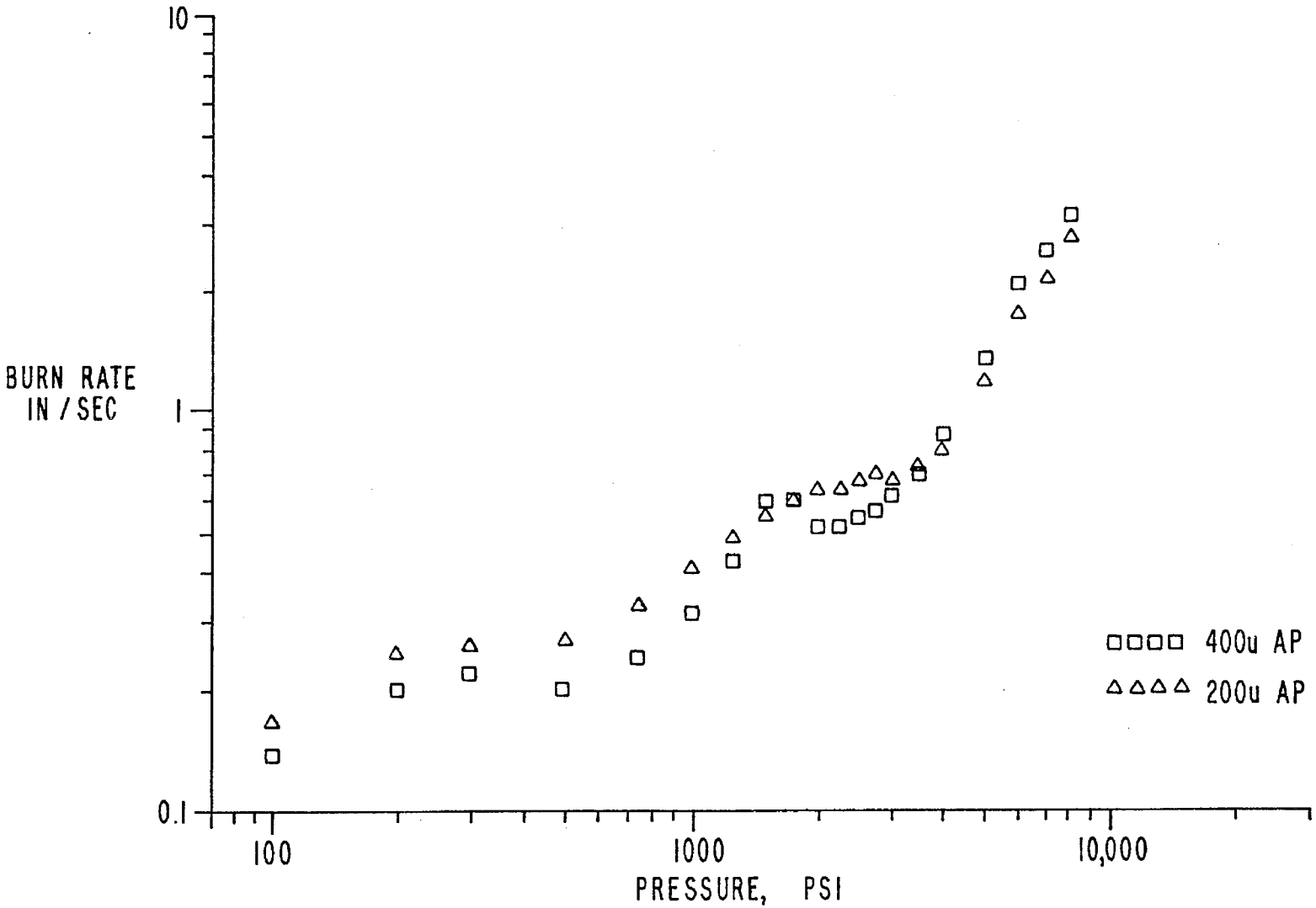
FIG. 5 is a burn rate versus pressure plot illustrating the performance of two propellants having varying AP particle size.

FIG. 5 is a plot of burn rate versus pressure for two formulations with varying ammonium perchlorate particle size. Ammonium perchlorate particle size was 200μ or 400μ. Again, it can be seen that the precise performance characteristics of the propellant may be varied by variation of the AP particle size. However, acceptable biplateau results are achieved in both of the illustrated cases.

Figure 6:
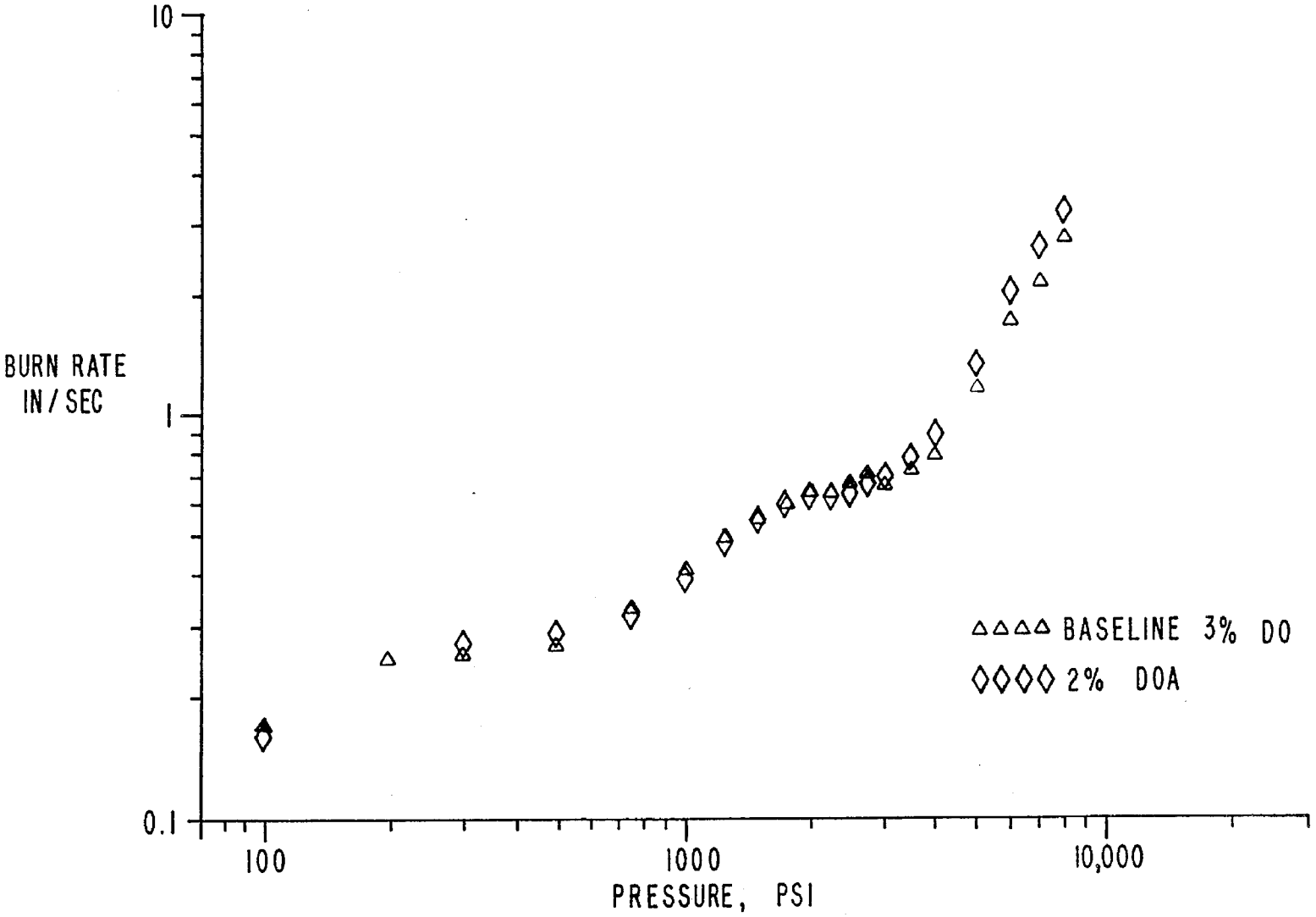
FIG. 6 is a burn rate versus pressure plot illustrating the performance of two propellants having varying DOA content.

FIG. 6 is a similar plot of burn rate versus pressure for compositions having varying amounts of DOA. As with the other factors discussed, precise variations in performance can be achieved by variation in the DOA content. However, for both formulations acceptable results are achieved.

Thus, the present invention provides propellant formulations which are capable of multi-phase or biplateau operation. At the same time, by adjustment of the characteristics and quantities of specific ingredients, it is possible to make precise adjustment to the burn rate versus pressure plot of the formulation. As mentioned above, various refractory oxides may be used. In the primary embodiments discussed herein, however, $TiO_2$ is used. The present invention provides the user with the opportunity to achieve thrust output characteristics which have heretofore only been achievable using liquid fuel motors or complex propellant and casing design.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

A propellant was formulated within the scope of the present invention. The formulation demonstrated a region of low exponent between 200 and 700 psi and between 1500 and 3000 psi. Low exponent is defined as <0.2 and is characterized by a reduced slope in the burn rate versus pressure curve.

The formulation is shown below:

| Ingredient | % (by weight) |
|---|---|
| R45M | 7.417 |
| Tepanol | 0.050 |
| DOA | 3.000 |
| $TiO_2$ (0.4μ) | 2.000 |
| AP 400μ | 53.320 |
| AP 1.7μ | 32.680 |
| ODI | 0.020 |
| TPB | 0.020 |
| DDI | 1.493 |

This formulation was scaled-up and the ballistic performance demonstrated in 2"×4" ballistic test motors. A burn rate versus pressure plot for this composition is shown in FIG. 1 in which both strand data and motor data are presented. The discussion of FIG. 1 provided above is incorporated by reference into this example.

In addition, the actual pressure time traces from the 2"×4" test motors are shown in FIG. 2. It should be noted that charge 5 which was nozzled to operate in the transition part of the burn rate curve did indeed show stable burning at two operating pressures.

Examples 2–14

In these Examples, formulations within the scope of the present invention were prepared. The formulations were similar in content to that set forth and described in Example 1, except that the amount and particle size of $TiO_2$ varied. As shown in Table I, the percentage of $TiO_2$ was 2.0% in the case of examples 2–3, 6–8, and 11–14. In examples 4–5, $TiO_2$ comprised 1.0%, while it comprised 1.5% in example 9 and 0.4% in example 10.

The curing agent was either DDI for examples 4–14, or a mixture of DDI and IPDI in the case of examples 2–3. In example 2, IPDI and DDI were added in a 1:1 ratio. In example 3, the IPDI to DDI ratio was 1:2.

Examples 11–14 provide data for aluminized formulations. As shown in Table I, aluminum content varied from about 5% to about 16%.

Table I presents plateau range exponent and burn rate data for each of the above-mentioned formulations.

TABLE I

FORMULATION DIFFERENCES ON BIPLATEAU PROPELLANT BALLISTICS

| | FORMULATION | | | PLATEAU RANGE (PSI)/EXPONENT/AVG. BURN RATE IN PLATEAU RANGE (IN/SEC) | |
|---|---|---|---|---|---|
| EX # | $TiO_2$, %/μ | Al, % | Cure Agent | Low | High |
| 2 | 2/0.4 | — | IPDI/DDI (1/1) | 10–300/0.22/0.25 | 1500–3000/<0/1.00 |
| 3 | 2/0.4 | — | IPDI/DDI (1/2) | 200–400/0.16/0.26 | 2000–3000/<0/0.80 |
| 4 | 1/0.4 | — | DDI | 300–800/0.21/0.24 | 2250–3000/0.05/0.57 |
| 5 | 1/0.4 | — | DDI | 200–750/0.27/0.23 | 2000–4000/0.36/0.56 |
| 6 | 2/0.4 | — | DDI | 200–800/0.22/0.25 | 1750–2500/0.22/0.56 |
| 7 | 2/0.4 | — | DDI | 200–800/0.22/0.25 | 2000–3000/0.22/0.57 |
| 8 | 2/0.02 | — | DDI | 200–750/0.46/0.35 | 2000–6000/0.15/2.89 |
| 9 | 1.5, 0.5/ | — | | | |
| 10 | 0.4, 0.02/ | — | DDI | 300–700/0.0/0.33 | 2000–4000/<0/1.65 |
| 11 | 2/0.4 | 5 | DDI | 200–500/0.18/0.23 | 1500/3000/0.24/058 |
| 12 | 2/0.4 | 10 | DDI | 300–700/0.25/0.24 | 2000–3000/0.40/0.58 |
| 13 | 2/0.4 | 15 | DDI | 300–500/0.28/0.23 | 1750–2750/0.40/0.51 |
| 14 | 2/0.4 | 16 | DDI | 750/1000/0.1/0.28 | 2000–4000/0.32/0.70 |

*Ballistic data confirmed in 2" × 4" test motors.

It will be appreciated from these examples that biplateau performance is achievable using various formulations of the present invention. This is true for both conventional ammonium perchlorate formulations and for aluminized formulations. In addition, these examples indicate that performance can be tailored by varying criteria such as $TiO_2$ particle size, $TiO_{2content}$, and the particular cure agent, or combination of cure agents used.

Examples 15–20

In these examples, percentages of ingredients, particle size, and curing agents were varied in order to product propellant formulations having specific desired characteristics. The propellant formulations and resulting plateau ranges and exponents are presented in Table II below. All ballistic data was confirmed in 2 inch by 4 inch test motors.

TABLE II

FORMULATION INFLUENCES ON DUAL PLATEAU PROPELLANT BALLISTICS

| | 0.4μ | Coarse | | Plateau Range/Exponent | |
|---|---|---|---|---|---|
| EX # | $TiO_2$, % | AP Size, μ | Curative | Low | High |
| 15 | 2 | 200 | IPDI/DDI 1/1 | 100–300 PSI 0.22 Inches/Sec | 1500–3000 PSI <0 -burn rate drops off |
| 16 | 2 | 200 | IPDI/DDI 1/2 | 200–400 0.16 | 2000–3000 <0 |
| 17 | 1 | 200 | DDI | 300–800 0.21 | 2250–3000 0.05 |
| 18 | 1 | 200 1% less AP | DDI | 200–750 0.27 | 2000–4000 0.36 |
| 19 | 2 | 400 | DDI | 200–800 0.22 | 1750–2500 0.22 |
| 20 | 2 | 400 | DDI | 200–800 0.22 | 2000–3000 0.22* |

Example 21

In this example, an aluminized propellant within the scope of the present invention was prepared. When this composition is burned, bi-plateau ranges were observed. The formulation was as follows:

| Ingredient | % (by weight) |
|---|---|
| Binder | 8.885 |
| Tepanol | 0.075 |
| DOA | 3.000 |
| $TiO_2$ | 2.000 |
| Al | 16.000 |
| AP | 70.000 |
| ODI | 0.040 |

The binder comprised R45M HTPB binder mixed with MAO and IPDI in approximately the following percentages: 92% HTPB, 1% MAO, 7% IPDI. This material is available commercially from ARCO.

This formulation was found to provide a bi-plateau effect when tested in the manner described in Example 1 above.

Example 22

In this example, an aluminized propellant within the scope of the present invention was prepared in the manner described in Example 21. In this example, bi-plateau ranges have been observed. The formulation was as follows:

| Ingredient | % (by weight) |
|---|---|
| Binder (see example 21) | 7.321 |
| Tepanol | 0.075 |
| DOA | 3.000 |
| $TiO_2$ | 2.000 |
| Al | 15.000 |
| AP (400μ) | 44.020 |
| AP (1.7μ) | 26.980 |
| ODI | 0.040 |
| DDI | 1.564 |

This formulation was found to provide a bi-plateau effect when tested in the manner described above.

Example 23

In this example a propellant composition within the scope of the present invention was formulated. The formulation was observed to have excellent potlife (in excess of 8 hours) and excellent end of mix viscosity (≦10 kP), while still exhibiting the other favorable characteristics of the present invention. The formulation was as follows:

| Ingredient | % (by weight) |
|---|---|
| Binder | 8.885 |
| Tepanol | 0.075 |
| DOA | 3.000 |
| $TiO_2$ | 2.000 |
| AP | 85.00 |
| ODI | 0.040 |
| $ZrC_2$ | 1.000 |

The binder employed is the same binder as that described in Example 21.

SUMMARY

The propellant formulations of the present invention provide numerous possibilities for changing from one operating pressure to another with only a small change in propellant burning surface. Applications of this type include launch-eject, boost sustain, sustain-boost, and other operational combinations. The present invention enables these propellant formulations to be tailored to provide plateau burning at pressures <100 psi up to >7000 psi, with burning rates from <0.2 in/sec to >2.0 in/sec.

The described capability is achieved by the addition of the refractory oxide to the formulation, and by variation of various parameters within the formulations. Such parameters include, but are not limited to, the exact percentages of ingredients in relation to the other ingredients in the formulation, particle size (such as AP or refractory oxide), the addition of cure agents, process aids, and the like, and the presence or absence of aluminum.

In summary, the present invention accomplishes the objects of the present invention. The propellant formulations of the present invention overcome many of the limitations of the art for achieving managed energy output. Specifically, the present invention provides propellant formulations which are capable of operating in a "biplateau" manner. That is, the propellant is capable of operating at at least two substantially stable burn rates. The burn rate can be selected or changed during operation and the propellant is capable of operating at more than one burn rate, depending on the pressure under which the propellant is burning. In this manner it is possible to control the operation of a solid propellant rocket motor.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method of burning a solid rocket motor propellant at at least two stable burn rates over at least two corresponding pressure ranges, the method comprising the steps of:

formulating a solid rocket motor propellant comprising from about 6.0% to about 10% of a binder consisting essentially of hydroxyterminated polybutadiene; from about 65% to about 90% ammonium perchlorate; and from about 0.3% to about 5.0% refractory oxide selected from the group consisting of $TiO_2$, $Al_2O_3$, $SiO_2$, and $ZrO_2$; and igniting said solid rocket motor propellant whereby the propellant formulation burns at at least two stable burn rates over at least two corresponding pressure ranges such that the propellant provides boost-sustained operation when burned in a solid rocket motor.

2. A method of burning a solid rocket motor propellant as defined in claim 1 wherein the particle size of the refractory oxide is in the range of from about 0.02μ to about 0.4μ.

3. A method of burning a solid rocket motor propellant as defined in claim 1 wherein the propellant further comprises a cure agent.

4. A method of burning a solid rocket motor propellant as defined in claim 3 wherein the cure agent is selected from the group consisting of isophorone diisocyanate and dimeryl diisocyanate.

5. A method of burning a solid rocket motor propellant as defined in claim 1 wherein the ammonium perchlorate comprises particles having sizes in the range of from about 1μ to about 400μ.

6. A method of burning a solid rocket motor propellant as defied in claim 5 wherein the ammonium perchlorate is of at least two distinct particle sizes.

7. A method of burning a solid rocket motor propellant as defined in claim 1 wherein the refractory oxide is $TiO_2$.

8. A method of burning a solid rocket motor propellant as defined in claim 1 wherein the propellant comprises about 1.0% to about 2.0% refractory oxide.

9. A method of burning a solid rocket motor propellant as defined in claim 1 wherein the propellant comprises from about 6.0% to about 10.0% hydroxy-terminated polybutadiene binder.

10. A method of burning a solid rocket motor propellant as defined in claim 1 wherein one said pressure ranges from about 200 psi to about 800 psi.

11. A method of burning a solid rocket motor propellant as defined in claim 1 wherein one said pressure ranges from about 1500 psi to about 4000 psi.

* * * * *